United States Patent [19]

Grass

[11] 4,368,558

[45] Jan. 18, 1983

[54] DOOR HINGE WITH A PRESSURE CLOSING DEVICE

[76] Inventor: Alfred Grass, Konsumstrasse 20, A-6973 Höchst/Vlbg., Austria

[21] Appl. No.: 149,275

[22] Filed: May 12, 1980

[30] Foreign Application Priority Data

Nov. 11, 1979 [DE] Fed. Rep. of Germany ..... 2947153

[51] Int. Cl.[3] ..... E05D 11/10

[52] U.S. Cl. ..... 16/332; 16/379

[58] Field of Search ..... 16/190, 50, 332, 379, 16/389; 49/398

[56] References Cited

U.S. PATENT DOCUMENTS 3,212,124 10/1965 MacDonald ..... 16/190 X
3,835,585 9/1974 Anderson et al. ..... 49/398
4,109,344 8/1978 Rock et al. ..... 16/332

FOREIGN PATENT DOCUMENTS 7824885 2/1979 Fed. Rep. of Germany .
2818735 11/1979 Fed. Rep. of Germany ..... 16/332
111324 6/1967 Norway ..... 16/190
1301050 12/1972 United Kingdom ..... 16/50

*Primary Examiner*—Werner H. Schroeder
*Assistant Examiner*—Andrew M. Falik
*Attorney, Agent, or Firm*—Parmelee, Miller, Welsh & Kratz

[57] ABSTRACT

A pressure operated hinge for swingably mounting a door on a frame behind their exposed front portions is of three parts involving a box having pressure elements to be mounted within a back-positioned cavity in the door, a swing arm part that carries a rounded, pin-like guide surface provided with at least one contoured slot therein, and a frame mounting plate part that is adapted to be adjustably secured by a set screw and a tongue and groove connection to the swing arm part. The operating relation between the pressure elements and the guide surface is designed to minimize friction therebetween, and the swing arm is adapted to move into the box to provide a substantially flush positioning when the door is fully closed.

14 Claims, 28 Drawing Figures

DOOR HINGE WITH A PRESSURE CLOSING DEVICE

An object of the present invention is to provide an improved door hinge with a pressure closing device and, if needed, with a pressure opening device.

By way of example, a prior art device has a bearing arm that is adapted to be mounted on a door frame and that is provided with a guiding member at its free end. Such guiding member has a guiding curve or arcuate surface which is positioned in operative adjacency with a spring-loaded pressure element. The latter is operatively carried in the other furniture part, for instance, the door or door leaf, and its guiding curve, at least in the closing position of the door, is adapted to exert a turning movement in a door-closing direction. The above-mentioned door hinge construction has been known, for example, through the publication of U.S. Pat. No. 3,212,124. The spring-loaded pressure element is shown therein as embedded in a receiving thickness portion of the door, itself. The bearing arm which at its free end has a guiding member and curve is shown fastened to the door frame. This known door hinge is essentially a single link hinge which can be also designated as only a partially covered hinge, since the hinge joint with the door closed can be seen from the door side edge that is hinged to the frame (see FIGS. 1 and 5 of the patent).

The visibility of such a link hinge results from the desired opening angle of the doors which can attain 180° according to the door leaf thickness and the chosen position of the hinge axis. It means that in order to achieve a large door swinging angle, the rotation axis has to be located at the greatest possible distance from the side and as close as possible to the door side edge.

This known type is disadvantageous in its operation, since the closing force on the door during its movement from an open position to a closed position increases uniformly while the moment lever (the force application point of the spring-loaded pressure element) varies in such a manner that the greatest maximum force is applied just before the end of the final closing period. This results in a blocking of the mechanism, since in the closed position the flat-shaped tip of the pressure element is applied against a conjugate straight surface of the guiding curve of the guiding member. The closing position is the sum of all moments and therefore equals zero; there is no force applied at the closed position to maintain the door securely in a closed position.

A further disadvantage is that the tip of the pressure element and the conjugate guiding curve are exposed to relatively great wear and a single closing device has to produce the full closing pressure for the door. With a relatively heavy door for which the closing force has to be correspondingly greater, the spring and the pressure element have to be dimensioned so strong that friction force between the pressure element tip and the guiding curve on the guiding member strongly increases.

Also, such known type of door hinge with its pressure closing device has the drawback that the hinge plates protrude beyond the furniture planes of the door and the furniture body or frame. This results in an unesthetic appearance, since one has to consider the appearance of larger distances between the door and the frame. The subsequent equipment of an already placed door with a door hinge employing a pressure closing device is not possible. Further, in the known door devices of this type, nothing has been foreseen to achieve a supplemental adjustment in the height, lateral and depth directions, in order to correct installation errors and for a precise, accurate adjustment of the door.

This task of the present invention is to further develop an improved door hinge with a pressure closing device of this general type in such a manner that the final closing force is essentially equally large, and that in a closed position the securing force will continue to be exerted on the door.

A pressure closing device of reduced dimensions is incorporated within the door hinge area in an unobtrusive manner, permitting attainment of even, continuous, high closing pressure without strongly increasing wear. As a further advantage, this provides an additional force in the closing direction.

BRIEF SUMMARY

For solution of the problem, the invention may be characterized as a pressure door hinge formed as a two part, single link hinge having an attached to the door body bearing arm that is conjugated with a bearing arm hinge box. The box is adapted to be mounted from the inside of the door and has one or more pressure elements operatively positioned therein. The tip of each pressure element is sloped in a wedge shape and has a wedgelike surface forming guiding curve to cooperate with a guiding member.

A characteristic of the present invention is the fact that there is provided a semicovered, two-part, adjustable, one link hinge in a pressure-closing device. The door hinge or pressure closing device is incorporated in a sunk-in door hinge box which essentially permits avoidance of protrusion of the device, itself, beyond the front side of the door. The use of a hinge box for the mentioned two-part, one link hinge permits attainment of the advantage that in a single hinge box there can be placed, not only one pressure locking device but two or more pressure-locking devices. Closing force may be exerted by several, parallel-to-each-other, acting, pressure closing devices in such a manner that even with a heavy door, necessitating strong closing forces, no noticeable wear takes place. Thus, separate pressure closing devices can be relatively small dimensioned and a desired total closing force may be effectively provided.

The characteristic that the pressure element tip is wedgelike sloped and is conjugated with a slanting wedgelike surface of a guiding curve on a guiding member, enables a closing force application throughout the whole domain of the closing angle to remain uniform and equally large. Also, in the closed position, there remains acting a certain active, position-maintaining force. The guiding curve can be so shaped that, even in an open position, there is being provided an open pressure force which holds the door open in a determined position.

BRIEF DESCRIPTION OF THE DRAWINGS

And, FIGS. 26 and 27 are fragmental perspective views in elevation showing the outside appearance of the door and frame mounted relation of the parts of a hinge of my construction such as represented by FIG. 21.

In FIGS. 1, 2 and 13 to 14 is shown a form of a hinge box 23 that is shaped as a door-countersunk box. The body side connection of a bearing arm 31 with respect to the frame 2 is adjustable in both heighth-horizontal and lateral or vertical directions.

FIG. 1 shows body side of frame mounted adjustment and swing or bearing arm parts of the hinge, while FIG. 2 shows an edge-inset, door-inside-mounted part 27 of the hinge box 23. In FIG. 3, the part 27 is of semi-circular section, while the part 28 of FIG. 4 is of rectangular section.

In FIGS. 1 and 2, bearing arm 31 is indirectly mounted on an attached body side frame ledge 2*a* by means of a fastening screw 32. According to FIGS. 1 and 2, there is provided a small distance or spacing between the hinge rotating axis and the door edge side. This, according to FIG. 1, is achieved thanks to the circumstance that the hinge box 23 terminates with the door edge side as a secant. The cavity 27 is carried out as a semi-circular blind bore of FIG. 3, or as a through cavity 28 of rectangular section according to FIG. 4. The edge-side opening of these FIGURES is moreover necessary to provide a free position for arm 31 at the opening of the door (see, for example, FIGS. 15 and 16).

Regarding the carrying-out of a covered located hinge, attention is called to my German Pat. No. G 78 24 885.8. This publication should be taken as supplementing the present application, in that it shows the importance of the formation of the hinge box in connection with other characteristics.

As based on FIGS. 5 to 8, the functioning of the pressure closing devices is explained hereinafter in more detail.

Figure 1:
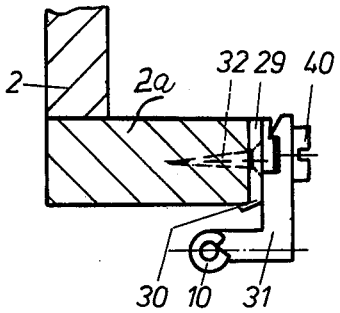
FIG. 1 is a horizontal section through side frame parts on which an embodiment of my invention is shown mounted.

Initially the guiding member or cam 10 is stationarily fastened to the bearing arm 31 of FIG. 1 that is mounted on the ledge 2*a* of the frame 2. The hinge box 23 with its pressure closing device, consisting of hollow pressure element 5 and cooperating inset spring 4, is arranged as movable in relation to a pin rotation axis 34 (see FIG. 5). Spring force of the tip 6 of the pressure element 5 is designated as $K_F$, while the resultant pressure closing force is represented by $F_R$. In this representation of FIGS. 5 and 6, the door 1 has not yet attained its final closing position. At this time, angle 38 with the horizontal of the wedge-like surfaces of the tip 6 of the pressure element 5 is larger than the angle 30*a* of the guiding or surface curve 35 of guiding member 10. It is essential that, as a consequence, the wedge-like surfaces of the tip 6 of the pressure element 5 and of the guiding curve 35 diverge from each other, because it produces the resultant force $F_R$ with a distance "a" from the rotation axis 34 of pin 9 (see also FIG. 12).

Figure 5:
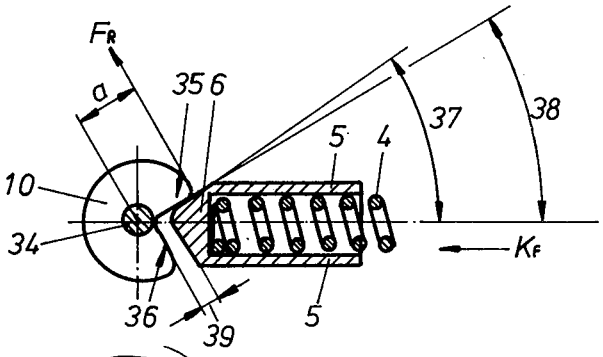
FIG. 5 is a schematic horizontal section illustrating force transmission from the pressure element to the guiding member of my construction.

The presentation of FIG. 5 can be also interpreted in such a manner that the door 1 is already in its closed position. It is then essential that, in the direction of the force $F_R$, there is exerted on the door 1 a permanent closing force. The wedge-like tip 6 of the pressure element 5 features a distance 39 as caused by a spaced relation; a cavity is thus formed by both of the wedge-like shaped guiding curves 35 and 36. The distance 39 or the clearance between the tip 6 of the pressure element 5 and the bottom of the depression, as defined by the guiding curves 35 and 36 in the guiding member 10, serves to hold the door 1 in its closed position. This is true even when the door 1 is not assembled precisely at right angles with the furniture frame structure. That is, the distance 39 guarantees a closing force on the door 1 with respect to the door frame 2 which acts beyond the normal closing position of the door.

Figure 6:
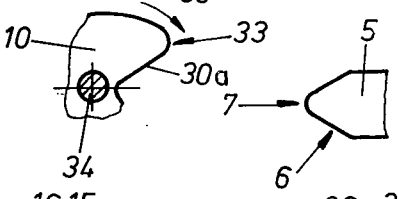
FIG. 6 is a fragmental schematic view of the guiding member and of the tip of the pressure element of the construction of FIG. 5 showing the radii.

FIG. 6 shows that it is essential to use a rounded-off surface 33 at the guiding curves 35 and 7 at the tip 6 of the pressure element 5, in order to achieve a sliding and relatively frictionless passage of the tip 6 of the pressure element 5 in the represented arrow direction, along the guiding curve 35 and over the radius of surface 33.

Figure 7:
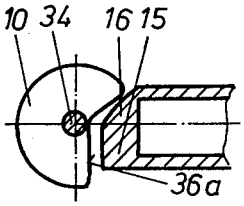
FIG. 7 illustrates a guiding member and the pressure element combination in another form of my construction.

FIG. 7 shows that, to the closing direction, conjugated guiding curve 35 can be used with an oppositely located, associated, differently shaped, guiding curve or surface 36a. The guiding curve 36a serves then as a stop, such that the door 1 cannot then, when the head or end point 16 comes in touch with the guiding curve 36a, continue to be moved further in the closing direction. To the particular shape of the guiding curves or surfaces 35, 36a in FIG. 7 should be conjugated a corresponding pressure element, such as 15, with a conjugate tip 16.

Figure 8:
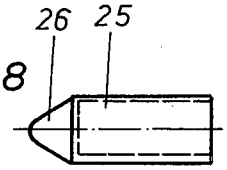
FIG. 8 is a side view of the pressure element in the form of FIG. 7.
Figure 9:
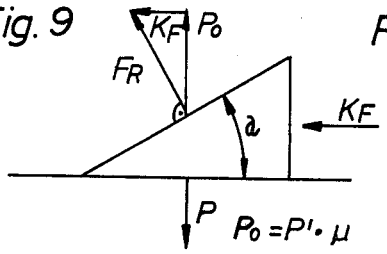
FIG. 9 is a schematic representation of mechanical friction conditions on wedge-shaped surfaces between the pressure element and the guiding curve of the guiding member.

FIG. 8 shows that there can be also provided a pressure element 25 with a conically shaped tip 26.

With reference to FIGS. 9 and 10a to 10c, relations are explained during the production of the closing moment $M_S$. The following is a list of designations and abbreviations:

$K_F$=Spring force (initial force)

d=Wedge angle $F_R$=The resultant producing the closing moment (1) P'=Frictional force=$K_F$ x tangent d (2) $P_O$=The normalized frictional force=P' x u (frictional losses)

u=Frictional coefficient (3) $F_R$=$P_O$ cosine d (4) $M_S$=closing moment - $F_R$ x a a=Distance between the rotation axis of guiding element 10 and the initial force application point on guiding curve 35 of such element Having chosen a wedge angle between 45° and 60°, the cosine is less than 1 at 60°, for instance, 0.866. The resultant $F_R$ will be alway larger than the $K_F$. The frictional engagement between a resin surface of one element and a metal surface of the cooperating element causes only small losses due to friction. The resultant wedge force $F_R$, produces through its normal distance from the rotation point, a working moment $F_R$x for the distance "a" to the rotation point, according to the diagrams shown in FIGS. 10a to 10c, and taking into consideration the force relations according to FIG. 9. In these diagrams, it is essential that throughout the whole working domain, the distance "a" of the application point on the guiding curve 35 of the guiding element 10 remains unchanged, and that therefore, independently from the closing angle, there is being produced an essentially constant closing movment $M_S$.

Figure 12:
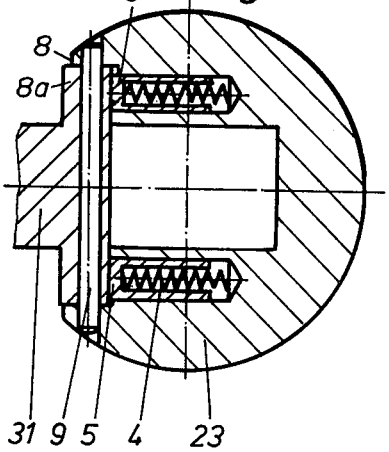
FIG. 12 is a section along the line 12—12 in FIG. 13 through a hinge according to FIGS. 1 and 2.
Figure 13:
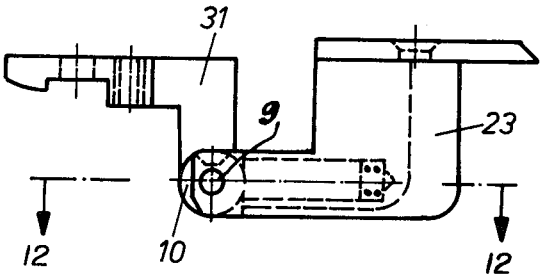
FIG. 13 is a top or horizontal view of a hinge according to FIGS. 1 and 2.
Figure 14:
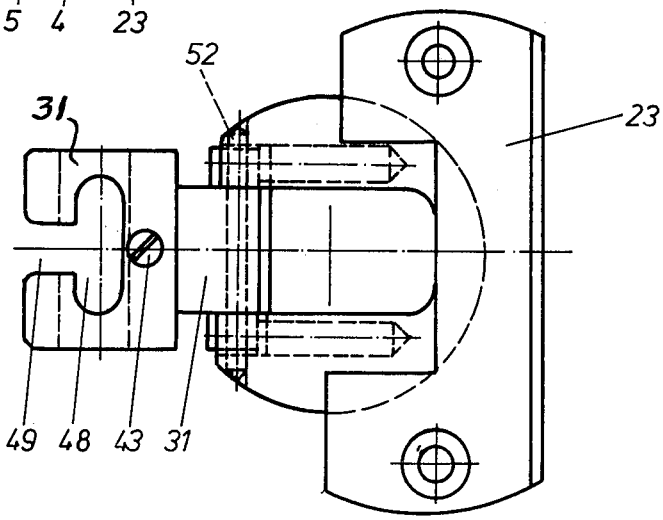
FIG. 14 is a vertical view of a hinge according to FIG. 1 and 2.

FIGS. 12 and 13 represent in more detail the locking cam construction of the door hinge, wherein a somewhat cylindrical and offset contoured guiding surface portion of the guiding member 10 that is carried by mounting pin 9, cooperates with the contoured tip end portion of the pressure element 9 to attain and retain the door 1 in a selected (closed or open) position. The bearing arm 31 with its guiding member 10 may be non-rotatably secured and supported on hinge pin 9 that has a pair of pressure elements 5 that are slidably received in corresponding closed-end bores in an adjacent end of the hinge box 23. In the illustrated embodiment, the elements 5 and the tension coil springs 4 provide a pair of pressure closing devices. FIG. 12 shows how the pin 9 is carried within a pair of ears 8 of the box 23 and a pair of cooperating ear end portions 8a of an enlarged foot end that constitutes the guiding surface portion of the arm 31, all in such a manner that the pin 9 may be inserted and removed endwise through the open bores in the ears 8 from the outside of the box 23 (as by a punch) to thus enable assembly and disassembly of the spring-pressed pressure elements 5.

As based on FIGS. 14 to 20, lateral and height adjustments of the hinge box 23 and therewith of the door 1 with respect to the frame 2 will now be explained.

Figure 15:
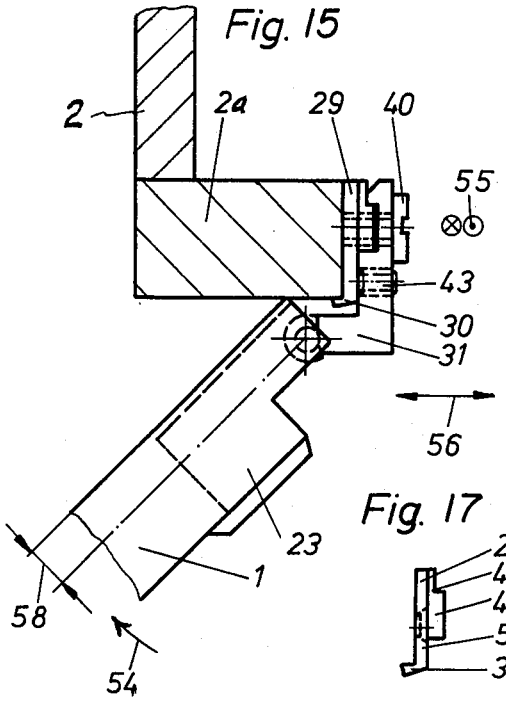
FIG. 15 is a horizontal view of the hinge construction according to FIGS. 1, 2 and 12 to 14 with the door in an open position.

According to FIGS. 13, 14 and 19, 20, the bearing arm 31 features an oblong hole or adjustment slot portion 48 (see FIGS. 14 and 20) that extends laterally to enable vertical or height adjustment (see arrow direction 55 of FIG. 15). Adjustment slot portion 48 has an open, centrally located, entry slot portion 49 that extends from its side edge. Height adjustment in the direction of the line 55 is achieved by means of a fastening machine screw 40, whose shank traverses the oblong slot 48 and penetrates into a threaded bore 41 (see FIG. 15 and 18 and 25). The screw-own plate 29 in the execution example shown is fastened to the edge of the frame ledge 2a (see FIG. 16) by a pair of wood screws 32 that extend through holes 29a in the plate. The plate 29 has a turned-over stop rib or ledge 30 that is adapted to engage (see FIG. 15) over the edges of the frame ledge 2a to facilitate accurate mounting of the screw-on plate 29.

The assembling of the bearing or swing arm on the screw-on plate 29 is made as follows: Begin by screwing-in fastening screw 40 into the threaded bore 41 in a laterally extending thickened tongue or guide portion 45 of the screw-on plate 29 (see FIGS. 15, 17 and 18). The bearing arm 31 is then pushed into position by moving its open slot portion 49 over the screw 40 to enter its shank within the adjustment slot portion 48. At the same time, a laterally extending groove or recessed portion 44 (see FIGS. 19 and 20 and 25) of the arm 31 will be placed in sliding alignment with the thickened guide or tongue portion 45 of the plate 29. The fastening screw 40 can now be tightened-down. It will be noted that to achieve a displacement of the bearing arm 31 in the direction of the arrow 55 of FIGS. 15 and 25, there is provided a tongue and groove guidance between it and the screw-on plate 29.

Figure 17:
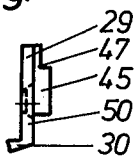
FIG. 17 is an edge view of a frame-attached screw-on plate.
Figure 18:
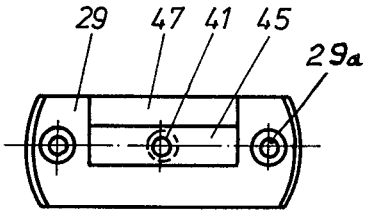
FIG. 18 is a vertical face view of the screw-on plate according to FIG. 17.
Figure 19:
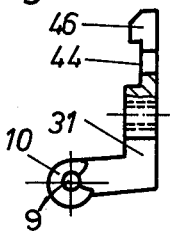
FIG. 19 is a side edge view through a frame side, movably or adjustably attached bearing arm.
Figure 20:
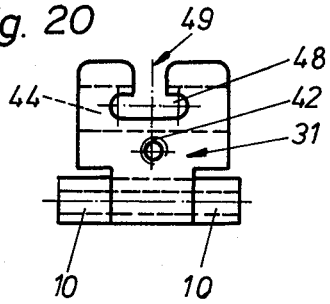
FIG. 20 is a vertical face view of the bearing arm according to FIG. 19.
Figure 25:
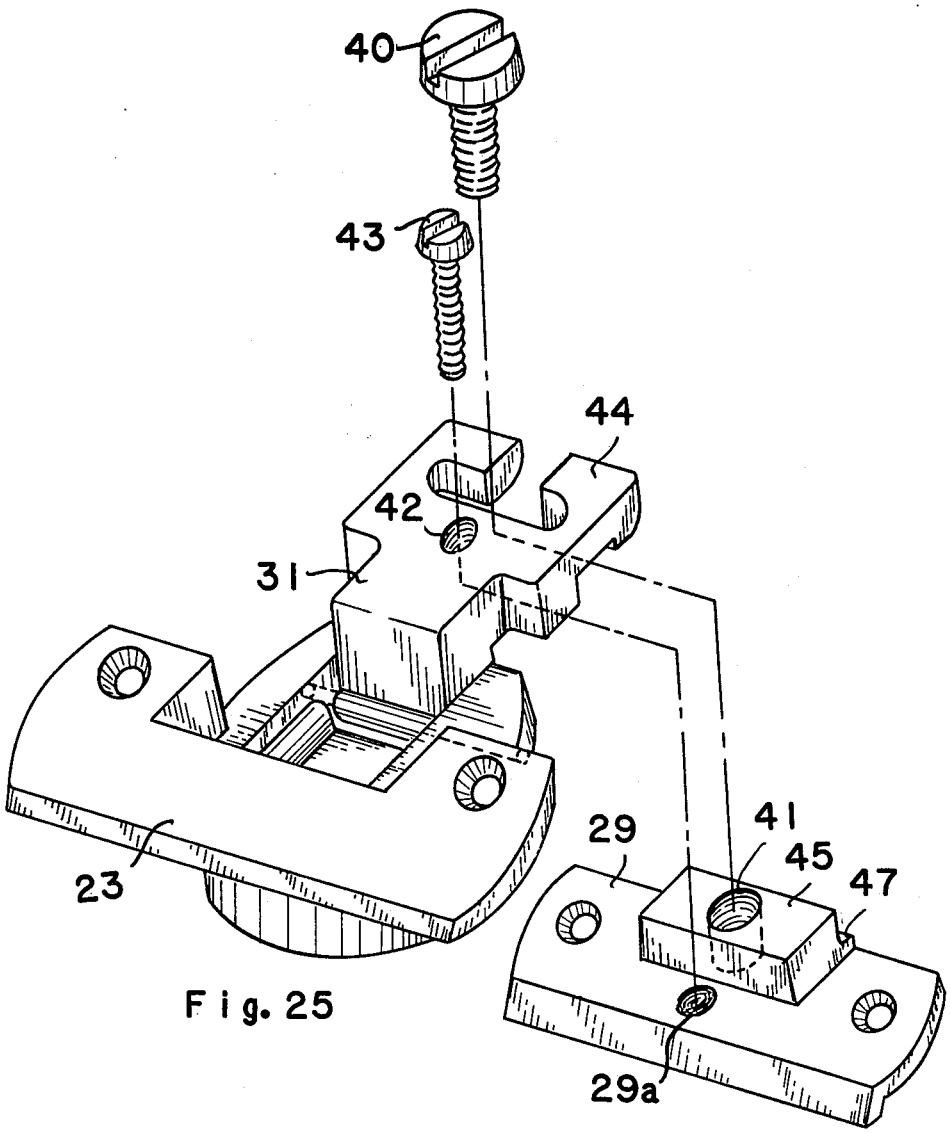
FIG. 25 is an enlarged, exploded isometric top plan view of the complete hinge of FIG. 21 in an open position.

According to FIGS. 17 and 25, the screw-on plate 29 features offset lateral surface portion 47 and tongue 45 which apply a conjugated slide surface with the bearing arm 31 (see FIG. 15). Heel 46 of the arm 31 also provides a slide-guide fit with the lateral surface portion 47 of the plate 29. Thus, when the fastening screw 40 is loosened, a guided-parallel, lateral translation of the bearing arm 31 may be effected in the arrow direction 55 without tilting the arm.

For an "in" and "out" displacement of the bearing arm 31 in relation to the frame 2, in the arrow direction 56 (see FIG. 15), there is provided a pressure machine screw 43 (see also FIGS. 14 and 25) that is adjustably threaded to extend through the bearing arm 31. This pressure screw 43 is screwed into a threaded hole 42 (see FIGS. 20 and 25) in the bearing arm 31 to apply its shank end against the surface of the screw-on plate 29 at 29a. Thus, a screwing-in of the pressure screw 43 with a loosening of the adjusting screw 40 will cause the bearing arm 31 to be displaced outwardly in an arrow direction of 56 to the right of FIG. 15. It will be apparent such adjustment between the arm 31 and plate 29 can be accomplished while retaining their guided relation, as governed by the inter-engaging depth relation of their tongue and groove interfit. Also, a tensioned relation may be provided between the arm 31 and the plate 29 by tightening the screw 43 down with respect to the position of the fastening screw 40.

Figure 2:
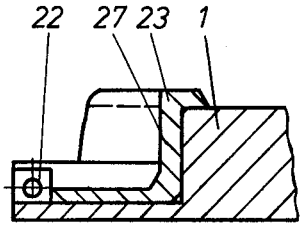
FIG. 2 shows a horizontal section showing a door back side face and end slot mounted hinge box of the door hinge according to FIG. 1.
Figure 3:
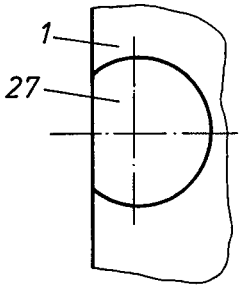
FIGS. 3 and 4 are representations of different shaped slots, notches or depressions in the door for installation of differently shaped hinge boxes in the general manner shown in FIG. 2.
Figure 4:
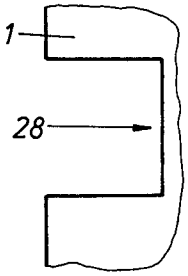
Figure 16:
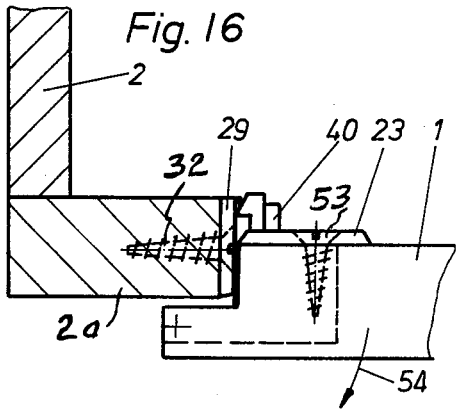
FIG. 16 shows the hinge according to FIG. 15 in a position in which the door is closed.

As shown, the embodiment of FIGS. 1 and 2 provides for lateral adjustment and the embodiment of FIGS. 15 and 16 also enables "in" and "out" adjustment. According to the embodiment of FIGS. 1, 2, 12 to 20, the adjustments may be made when the door 1 is in its open position, with the on-the-door-end located hinge box 23 securely mounted in position by wood screws 53, and with the plate 29 securely mounted on the frame ledge portion 2*a* by wood screws 32. For a correct positioning in a depth direction which cannot be adjusted subsequently, the screw-on plate 29 features the jutting ledge 30. The opening of the door 1 makes the wood screws 32 and the fastening screw 40 and the adjusting screw 43 accessible for operation. As previously indicated, the fastening screw 40 is to be slightly loosened when the door 1 is to be adjusted height-wise (arrow direction 55). The door 1 is assured against falling-off when the fastening screw 40 has been loosened by means of the above-described tongue and groove connection or system 44, 45, 46 and 47 which permits a smooth vertical displacement of the bearing arm 31 with respect to the screw-on plate 29 within the lateral or cross extent of the slot portion 48. The parallel guidance through the above described tongue and groove system prevents tilting of the bearing arm 31 during displacement.

The door 1 can be easily dismantled which is advantageous when the screw-on plate 29 is pre-assembled by the manufacturer. The subsequent adjustability permits such pre-assembling. According to FIG. 16, the height and "in" and "out" adjustment devices are incorporated within the hinge box 23 and are hidden from front view when the door 1 is in its closed position.

Figure 21:
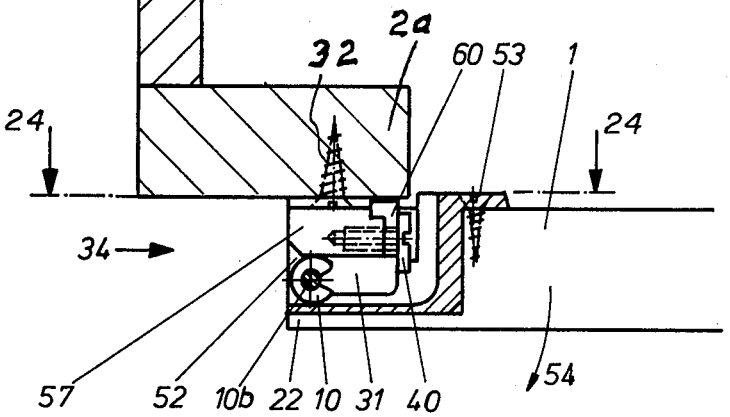
FIG. 21 is a horizontal section showing a door hinge in a closed position of a further preferred embodiment of my invention in which the screw-on plate is placed and screw-secured on the front side of a furniture frame.
Figure 22:
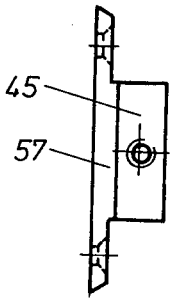
FIG. 22 is a vertical edge view of the frame side-mounted plate of FIG. 21.
Figure 23:
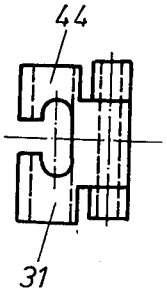
FIG. 23 is a vertical side view of the conjugated bearing arm of the embodiment of FIG. 21.
Figure 24:
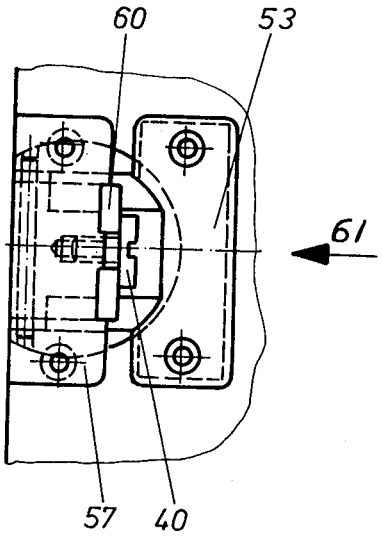
FIG. 24 is a vertical view of the complete hinge according to the embodiment of FIG. 21.

In the embodiment example according to FIG. 21, screw-on plate 57 is screwed-on to the front side of the ledge body 2*a*, as distinguished from the side edge as shown in the embodiment of FIG. 15. In the embodiment of FIG. 21, the screwing-on of its plate 57 on the front side of the frame ledge portion 2*a* is favorable to the assembling operation. In order to make the fastening screw 40 accessible for a subsequent necessary adjustment, it may be displaced by 90°, as well as the tongue-groove guidance connection that is shown in detail in FIGS. 22 and 24. It is important that the screw-on plate has a leg 60 (see FIG. 24) that may be turned over by 90°, so that there is attained the situation shown in FIG. 21. In FIGS. 22 and 23, the screw-on plate 57 and the bearing arm 31 are shown mounted in the direction of the arrow 61 of FIG. 24. Further, it is noted in the embodiment of FIGS. 15 and 21 that the door 1 is capable of opening in the direction of arrow 54 of FIG. 15 to an angle exceeding 90°. It is even possible with a corresponding choice of distance 58 in FIG. 15 to open the door to 180° with respect to its closed position. The same applies to the execution example according to FIG. 21.

Figure 11:
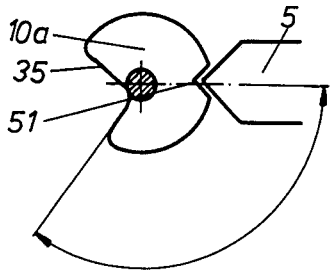
FIG. 11 is a representation of a guiding curve with a pressure opening operation.
Figure 10A:
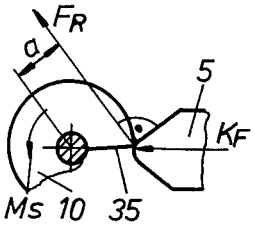
FIG. 10*a* to 10*c* are schematic representations of the production of closing moment at different open positions of the door.
Figure 10B:
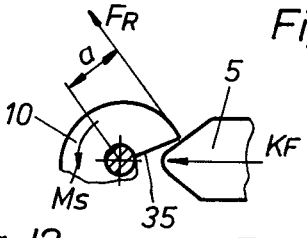
Figure 10C:
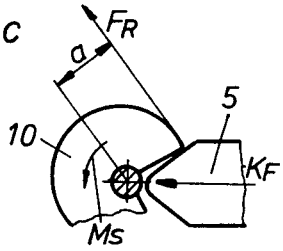

All the described pressure closing devices can also be equipped with a pressure opening device, as shown for example by the guiding curve or surface 51 of FIG. 11. In this situation, as opposed to the guiding curve 35 that is conjugated with the closing position, the guide curve or surface 51 is arranged on the guiding member 10*a* conjugated with the opening position. Within boundaries of the present invention it has been foreseen to replace the exemplary coil springs 4 with other suitable force exerting means such as hip springs. The blind bores 19 will then be widened in a complementary manner to lodge the hip spring wings.

Without departing from the invention, mounting of the hinge box 23 can be made on the frame 2 (ledge 2*a*), while the screw-on plate 29 or 57 and the conjugate fastening of the bearing arm may be made on the door 1. Besides height and "in" and "out" adjustments (see the directional arrows 55 and 56 of FIG. 15), there is also the possibility of a depthwise adjustment. In a preferred execution form of the present invention, the pressure element 5 is preferably made of a resin-like material, while the guiding member 10, 10*a* is preferably made of metal material. As previously indicated, this tends to minimize friction therebetween. The present inventive door hinge may be designated as a semi-covered, two-part, unhingeable, at least two-way adjustable, one link hinge with automatic closing.

Figure 26:
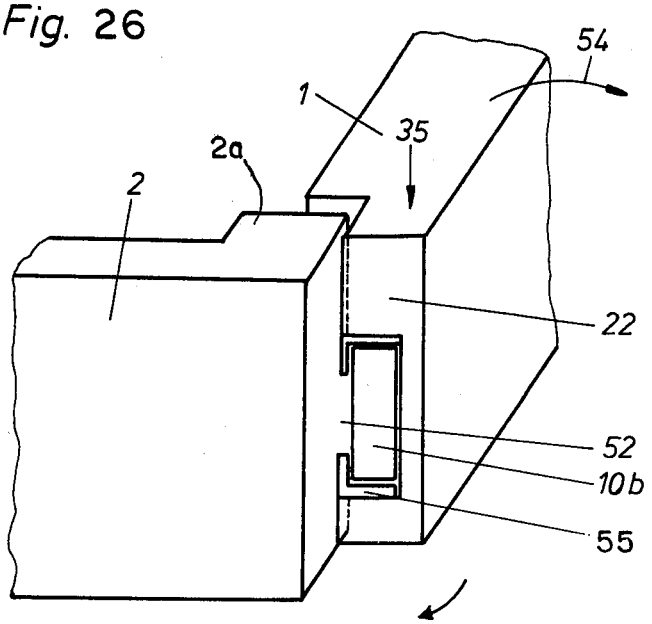
FIG. 26 is taken in the direction of the arrow 34 of FIG. 21.
Figure 27:
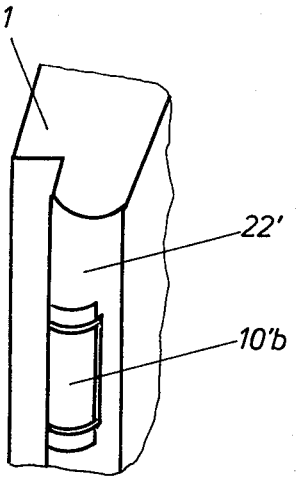

FIG. 26 is a perspective view in elevation taken in the direction of arrow 34 of FIG. 21, looking towards outside side edge 22 of the door 1. Hinge box 55 is here visible in an open outward depression 51 in the side edge 22. FIG. 27 is a fragmental perspective view in elevation taken in the direction of the arrow 35 of FIG. 26 of the door 1 from above; it differs from the showing of FIG. 26 from the standpoint that side edge or end 22' of the door 1 and the outer end of guiding element 10'*b* are rounded or semi-circular, as compared to the planar shape of corresponding portions 22 and 10*b* of FIG. 26. In both cases, the guiding member has a portion 10*b* or 10'*b* that is visible from the outside when viewing the side edge 22 or 22'. In these execution examples, it is important that the shape (profile) of the visible portions 10*b* and 10'*b* of the guiding member correspond to the profilation of the side edge side 22 or 22' of the door 1. Instead of a semi-circular section profile according to FIG. 27, the visible portions 10*b*, 10'*b* can be shaped to a triangular or oval profile, and also to a concave, semi-circular profile. In this manner, the profilation of the visible portions can be adapted to satisfy configurative demands.

Recapitulating, it is believed that the technical execution of my closing device and of its pressure element to make the produced closing force constant over the whole domain of the closing angle is new in the art. It importantly makes possible that the door has, in its closed position, a holding force acting thereon. It also importantly enables the closing mechanism to be located in a hinge box on the door side, and for the hinge box to have incorporated therein one or two pressure closing devices. Equally new is the fastening and adjustment technique as above-described.

In FIG. 5, it will be noted that the slope angle 38 of the guiding surfaces 35 which may be between about 40° to 60° is greater than the slope angle 37 of the head or tip end 6 of the pressure element 5. As a result, the relative sliding engagement between the two opposed surfaces is substantially a sliding-line engagement that minimizes friction. It will be also noted that the end of the tip 6 is cut-off or truncated and rounded to provide it with a contoured or rounded wedge shape. As further indicated in FIG. 5, the guide surfaces 35 and 36 of the guiding element or part 10 are of hollow or slotted contoured or rounded wedge shape.

An important characteristic of the present invention consists in the possibility of height and sidewise adjusting displacement of one link hinge part. According to the invention, height and lateral displacements are foreseen when fastening the bearing arm to the frame. In a preferred execution example of the invention of FIGS. 1 and 2, a fastened-to-the body, screwed-on plate 29 has in it a hole for receiving a fastening screw 40 that with its shank grips through an oblong hole. Its axis extends in the direction of vertical displacement into a bearing arm 31, and its head holds the bearing arm fastened to the screwed-on plate 29.

From the foregoing, it will be noted that particular advantages have been obtained by arranging the aforesaid pressure closing devices in the hinge box of the link hinge.

It is moreover preferred that the pressure closing device consisting of a cooperating pressure element and guiding member be constructed in such a way that one or more blind bores are provided in the hinge box to incorporate springs that rest on the bore bottoms. It will be noted that in the arrangement proposed in U.S. Pat. No. 3,212,124, one link of the hinge is not integrated within a hinge box which results in a relatively high space requirement.

It is further noted that the hinge box of my invention is not limited to a single blind bore for the reception of a pressure closing device, but that there may be several, for example, two parallel ones (see FIGS. 12 and 14) arranged in blind bores, with each having a spring and a pressure element. In the arrangement of several pressure closing devices, the pressure elements of these act upon a single guiding curve which is arranged on the outer periphery of a tube-like element connected firmly against rotation, and with the bearing arm secured on the supporting body or cupboard frame.

The hinge box can be provided as an embedded box, and the frame mounted hinge part may have a screwed-on plate with an integral or cast-on bearing arm. The guiding curve (closing curve) as formed out of the walls around the bearing bore is concave and V-shaped. The pressure element which is retained through the intermediary of a pressure coil spring in force-transmitting active contact with the closing curve is, on its front side, shaped wedge-like to exert a closing pressure through a slanting wedge-like surface on one side. An opposed, second, slanting, wedge-like surface serves for stopping movement of the door when it has reached a closed stopping position. At this time, the wedge (as formed by opposed guiding curves) of the pressure element moves into application against the V-groove shaped surface of the guiding curve on the guiding member.

The stoppage may, however, be desired only in some cases and can, if desired, be omitted should it become necessary that in the closed position there remain only a remnant closing pressure available. Employing a hinge device of my invention, the door will close and remain closed, even in the case of a not strictly rectangular or an off-shaped door body.

In the boundaries of the present invention there is proposed a new fastening and adjustment technique for a door hinge. When the door is in an open position, the pressure box and bearing arm may be firmly assembled with the door secured thereto by means of attachment screws within the adjustment domain or extent of a screw-on plate. The plate may be fastened to the door by two wood screws. A correct positioning in depth is not possible subsequently in the construction of U.S. Pat. No. 3,212,124, since the screw-on plate features a jutting of the screw-on plate surface striking ledge. In my construction, the door-opening wood screws, and the fastening screw can be conveniently adjusted. The fastening screw may be slightly loosened in such a manner that the door with the bearing arm can be adjusted height-wise.

The door is retained against down sag by means of a cam-groove connection (see FIG. 1) when the fastening screw is loosened, but a vertical, neatly carried-out displacement is permitted in order to achieve necessary height adjustment. To this effect, the opening which receives the shank of the fastening screw is shaped as a vertically oblong aperture. Guidance over the entire height (width) of the bearing arm prevents tilting. To a limited extent, a lateral displacement of the door may be obtained by means of a pressure screw located in the vicinity of the fastening screw. By tightening this screw with a previous loosening of the fastening screw, the bearing arm can be pressed away from the screw-on plate. This permits a lateral adjustment which can be fixed by means of the fastening screw. There is thus produced a bending tension between the axes of the fastening screw and the pressure screw on the bearing arm that provides a screw securing result.

Moreover, the door can be easily taken off which is advantageous in case the screw-on plate has been pre-installed by the furniture manufacturer. This additional adjustment possibility makes such a pre-installation possible, and the door becomes therefore separately transportable.

It is important that the screw-on and adjustment devices with the closed door remain mounted within the door-side hinge box to thus take little space and to be therefore not visible. In the construction of FIGS. 1 and 2, the screw-on plate can be shaped in such a manner that the screw-on adjustment means are embedded in the side edge of an edgewise-positioned ledge extension of the door frame, and the rotation axis is located in the middle of the door thickness. The door in such case should not be rabbited or grooved.

In the preferred form of my invention of FIGS. 15 and 16, the open door with completely installed door hinge is screwed-on the adjacent side edge of the frame, and a swing arm has a back-turned joint such that the swing arm does not protrude into the clear opening of the door bay in the frame. Also, when the door is closed, the swing arm and its screw-on mounting plate are hidden within the confines of a front side portion of the door and any open edge to back side mounted hinge box. The use of a door edge notch and the mounting of the screw-on plate from the side edge (instead of from the front side face) of the frame is also advantageous for assembling work. To make the fastening screw and, if necessary, a pressure adjustment screw more accessible for any necessary door adjustment, this may be arranged by displacing it as well as a tongue-groove connection by 90°.

I claim:

1. A pressure-operated hinge for substantially concealed door-closed mounting and door to frame position retention operation which comprises, a hollow hinge box adapted to be secured within the door from its back side, said box having a flange portion for mounting it on the door, said box in its mounted position being open to the back side and adjacent edge of the door, an angle-shaped swing arm adapted to be mounted on an adjacent portion of the frame to project forwardly towards the front side of the frame, said box having a pair of ears, pin means swingably journaling a forward end portion of said swing arm within said pair of ears for door swinging opening and closing movement with respect thereto, said box having an end portion open towards said swing arm to receive said swing arm therein when the door is in a closed position in such a manner as to substantially hide said swing arm from the front side of the frame and door, said forward end portion of said swing arm being a somewhat cylindrical contoured guiding surface portion provided with an offset thereon and being carried on said pin means, a pressure element operatively positioned within said box and having a contoured tip end portion, said guiding surface portion and said contoured tip end portion being in operative engagement, and spring means operatively positioned within said box to flexibly apply forward pressure to said tip end portion to maintain it in operating engagement with said guiding surface portion during swinging movement of the door and to exert a position-attaining and retaining force on the door when in operating engagement with said offset.

2. A pressure-operated hinge as defined in claim 1 wherein, said swing arm has a back end portion adapted to be secured to a side edge of the frame, said forward end portion of said swing arm extends along a front side of the frame adjacent the side edge thereof, and said forward end portion of said swing arm is swingable on said pin means to a position behind the front side of the door and within the open back portion of said hinge box when the door is in a closed position with respect to the frame.

3. A pressure-operated hinge as defined in claim 1 wherein, a screw-on plate is adapted to be mounted on the side edge of the frame, and means cooperates with said plate an inner end portion of said swing arm for adjustably mounting said swing arm with respect to the frame.

4. A pressure-operated hinge as defined in claim 3 wherein the mounting of said screw-on plate, said swing arm and said hinge box is reversed from the standpoint of the frame and the door as defined in said claim.

5. A pressure-operating hinge as defined in claim 3 wherein, said plate and the inner end portion of said swing arm have cooperating tongue and groove portions constructed for adjustment with respect to each other, and screw means cooperates with said plate and said swing arm to lock them in an adjusted position with respect to each other.

6. A pressure-operated hinge as defined in claim 1 wherein, said contoured guiding surface portion is a concave portion having a lesser slope angle than said contoured tip end portion whereby a substantially line engagement contact is provided therebetween.

7. A pressure-operated arm as defined in claim 6 wherein the angular slope of said contoured guiding surface portion is between about 40° to 60°.

8. A pressure-operated hinge as defined in claim 1 wherein said offset and said tip end portion are of complementary wedge-shape and cooperate to move the door into and retain the door in a selected position with respect to the frame.

9. A pressure-operated hinge as defined in claim 1 wherein, said tip end portion of said pressure element is of rounded convex wedge shape, and said offset of said guiding surface portion of said swing arm is of complementary rounded concave wedge shape to cooperatively move along said tip end in operative engagement therewith for urging the door towards and maintaining it in a desired position with respect to the frame.

10. A pressure-operating hinge as defined in claim 1 wherein said guiding surface and tip end portions are contoured to cooperatively urge the door towards and maintain it in an open position.

11. A pressure operating hinge as defined in claim 1 wherein said guiding surface and tip end portions are contoured to alternately urge the door towards and maintain it in a closed position and in an open position.

12. A pressure-operating hinge as defined in claim 1 wherein said pair of ears have open end portions to provide for positioning said pin means endwise therein, and said swing arm is swingably mounted on and with respect to said pin means.

13. A pressure-operating hinge as defined in claim 1 wherein said top end portion is of rounded convex wedge shape, and said guiding surface portion has a pair of offsets that are of rounded concave shape that are adapted to be operatively engaged by said tip end portion to urge the door towards and retain it in one of two positions with respect to the frame.

14. A pressure operating hinge as defined in claim 1 wherein, a pair of said pressure elements of rod-like shape is provided, said box has side-extending cylindrical bores therealong within which said pressure elements are slidably positioned, and said spring means is carried within said bores for urging said pressure elements into and maintaining them in engagement with said contoured guiding surface portion.

* * * * *